US008094119B2

(12) United States Patent
Nonaka et al.

(10) Patent No.: US 8,094,119 B2
(45) Date of Patent: Jan. 10, 2012

(54) INFORMATION PROCESSING APPARATUS, AND IMAGE DISPLAY APPARATUS AND METHOD

(75) Inventors: Ryosuke Nonaka, Kawasaki (JP); Masahiro Baba, Yokohama (JP); Goh Itoh, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 337 days.

(21) Appl. No.: 12/549,145

(22) Filed: Aug. 27, 2009

(65) Prior Publication Data

US 2010/0053066 A1 Mar. 4, 2010

(30) Foreign Application Priority Data

Aug. 28, 2008 (JP) ..... 2008-220093

(51) Int. Cl.
*G09G 3/36* (2006.01)

(52) U.S. Cl. ..... 345/102; 345/103; 345/87; 345/38

(58) Field of Classification Search ..... None
See application file for complete search history.

(56) References Cited

U.S. PATENT DOCUMENTS 7,622,697 B2 * 11/2009 Korcharz et al. ..... 250/205
7,656,371 B2 * 2/2010 Shimizu et al. ..... 345/83
2005/0184952 A1 8/2005 Konno et al. ..... 345/102
2008/0117231 A1 * 5/2008 Kimpe ..... 345/629

FOREIGN PATENT DOCUMENTS

JP 2005-309338 A 11/2005

* cited by examiner

*Primary Examiner* — Muhammad N Edun
(74) *Attorney, Agent, or Firm* — Ohlandt, Greeley, Ruggiero & Perle, L.L.P.

(57) ABSTRACT

An apparatus includes a unit computing, at each of positions on a target, first products of first reference values for light sources and factors for light sources, and a first sum of the first products corresponding to the light sources, and estimating, at each of the positions, the first sum as a first component at each of the positions, each of the first reference values being obtained referring to a first distribution, a unit computing a second sum of the factors for all of the light sources, and a second product of the second sum and second reference value, and estimating, at each of the positions, the second products as a second component at each of the positions, the second reference value being obtained referring to a second distribution that has a spatially constant value, and a unit computing a third sum of the first component and the second component.

9 Claims, 11 Drawing Sheets

INFORMATION PROCESSING APPARATUS, AND IMAGE DISPLAY APPARATUS AND METHOD

CROSS-REFERENCE TO RELATED APPLICATIONS

This application is based upon and claims the benefit of priority from prior Japanese Patent Application No. 2008-220093, filed Aug. 28, 2008, the entire contents of which are incorporated herein by reference.

BACKGROUND OF THE INVENTION

1. Field of the Invention

The present invention relates to an information processing apparatus for estimating the intensity distribution of irradiated light, and an image display apparatus and method.

2. Description of the Related Art

In conventional image display apparatuses, such as liquid crystal display apparatuses, which use light sources and optical modulation elements, control of the light source luminance is executed in each of the areas into which the entire illumination area of the light sources is divided, for the purpose of enlarging the display dynamic range and the purpose of power saving.

US Patent Application Publication No. 2005/184952 A1, for example, discloses a technique of controlling the luminance of each of the light sources that constitute a backlight, and estimating the intensity distribution of the light emitted from the backlight, with reference to intensity distribution data concerning the light emitted from each of the light sources.

However, if the illumination area of each light source is wide, and the adjacent illumination areas greatly overlap each other, a large storage capacity is necessary to store the light intensity distribution data of the light sources. Further, to estimate the intensity distribution of the light emitted from the backlight, a large number of computations are required.

To reduce the required storage capacity or the required number of computations, it is possible to approximate the actual intensity distribution of the light, emitted from each light source, by illumination intensity distribution data obtained using a spatial range narrower than the actual spatial range. In this case, however, an error due to the approximation made by ignoring the light of peripheral portions of each light source will inevitably occur.

BRIEF SUMMARY OF THE INVENTION

According to an aspect of the invention, there is provided a display apparatus comprising: a liquid crystal panel including a plurality of pixels arranged in a matrix-like manner; a backlight including at least one light source which applies light to the liquid crystal panel, the backlight adjusting the light emitted from the at least one light source; a computation unit configured to compute a luminance modulation factor of the at least one light source based on an image signal corresponding to each of the pixels; a first control unit configured to control the backlight based on the computed luminance modulation factor; an estimation unit configured to estimate an estimated value for each position on an intensity distribution of light applied by the backlight to the liquid crystal panel, based on the computed luminance modulation factor; a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes: a first computing unit configured to compute, at each of positions on the illumination target, a plurality of first products of first reference values for light sources and luminance modulation factors for the light sources, and a first sum of the first products corresponding to the light sources, and to estimate, at each of the positions, the first sum as a first component at each of the positions, each of the first reference values being obtained referring to a first distribution having a first width and included in a larger distribution that is included in illumination intensity distributions of the light sources, and has spatially different components and a second width, a center of the first width coinciding with a center of the second width, the first width being not more than the second width; a second computing unit configured to compute a second sum of the luminance modulation factors for all of the light sources, and a second product of the second sum and second reference value, and to estimate, at each of the positions, the second product as a second component at each of the positions, the second reference value being obtained referring to a second distribution that is included in the illumination intensity distributions of the light sources, and has a spatially constant value; and a third computing unit configured to compute, at each of the positions, a third sum of the first component and the second component, and to set the third sum as the estimated value.

According to another aspect of the invention, there is provided a display apparatus comprising: a liquid crystal panel including a plurality of pixels arranged in a matrix-like manner; a backlight including at least one light source which applies light to the liquid crystal panel, the backlight adjusting the light emitted from the at least one light source; a computation unit configured to compute a luminance modulation factor of the at least one light source based on an image signal corresponding to each of the pixels; a first control unit configured to control the backlight based on the computed luminance modulation factor; an estimation unit configured to estimate an estimated value for each position on an intensity distribution of light applied by the backlight to the liquid crystal panel, based on the computed luminance modulation factor; a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes: a first computing unit configured to compute, at each of positions on the illumination target, a plurality of first products of first reference values for light sources and luminance modulation factors for the light sources, and a first sum of the first products corresponding to the light sources, and to estimate, at each of the positions, the first sum as a first component at each of the positions, each of the first reference values being obtained referring to a first distribution having a first width and included in a larger distribution that is included in illumination intensity distributions of the light sources, and has spatially different component and a second width, a center of the first width coinciding with a center of the second width, the first width being not more than the second width; a second computing unit configured to compute, at each of the positions, a plurality of second products of second reference values for the light sources and the luminance modulation factors for the light sources, and a second sum of the second products corresponding to the light sources, and to estimate, at each of the positions, the second sum as a second component at each of the positions, each of the second reference values being obtained referring to a second distribution that is included in the illumination intensity distributions of the light sources, and has a spatially constant value; and a third computing unit configured to compute, at each of the positions, a third sum of the first component and the second component, and to set the third sum as an estimated value at each of the positions for an intensity distribution of light applied by the light sources to each of the positions.

According to yet another aspect of the invention, there is provided a display apparatus comprising: a liquid crystal panel including a plurality of pixels arranged in a matrix-like manner; a backlight including at least one light source which applies light to the liquid crystal panel, the backlight adjusting the light emitted from the at least one light source; a computation unit configured to compute a luminance modulation factor of the at least one light source based on an image signal corresponding to each of the pixels; a first control unit configured to control the backlight based on the computed luminance modulation factor; an estimation unit configured to estimate an estimated value for each position on an intensity distribution of light applied by the backlight to the liquid crystal panel, based on the computed luminance modulation factor; a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes: a separation unit configured to separate an illumination intensity distribution of each of light sources into a first distribution having spatially different component and a second distribution having a spatially constant value; a generation unit configured to generate a third distribution of the illumination intensity distribution having a first width not more than a second width of the first distribution, the first width having a center coinciding with a center of the second width; a first computing unit configured to compute, at each of positions on the illumination target, a plurality of first products of values of first reference values for light sources and luminance modulation factors for the light sources, and a first sum of the first products corresponding to the light sources, and to estimate, at each of the positions, the first sum as a first component at each of the positions, each of the first reference values being obtained referring to the third distribution; a second computing unit configured to compute a second sum of the luminance modulation factors for all of the light sources, and a second product of the second sum and second reference value, and to estimate, at each of the positions, the second product as a second component at each of the positions, the second reference value being obtained referring to the second distribution; and a third computing unit configured to compute, at each of the positions, a third sum of the first component and the second component, and to set the third sum as the estimated value.

According to yet another aspect of the invention, there is provided a display apparatus comprising: a liquid crystal panel including a plurality of pixels arranged in a matrix-like manner; a backlight including at least one light source which applies light to the liquid crystal panel, the backlight adjusting the light emitted from the at least one light source; a computation unit configured to compute a luminance modulation factor of the at least one light source based on an image signal corresponding to each of the pixels; a first control unit configured to control the backlight based on the computed luminance modulation factor; an estimation unit configured to estimate an estimated value for each position on an intensity distribution of light applied by the backlight to the liquid crystal panel, based on the computed luminance modulation factor; a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes: a separation unit configured to separate an illumination intensity distribution of each of light sources into a first distribution having spatially different component and a second distribution having a spatially constant value; a generation unit configured to generate a third distribution of the illumination intensity distribution having a first width not more than a second width of the first distribution, the first width having a center coinciding with a center of the second width; a first computing unit configured to compute, at each of positions on the illumination target, a plurality of first products of values of first reference values for light sources and luminance modulation factors for the light sources, and a first sum of the first products corresponding to the light sources, and to estimate, at each of the positions, the first sum as a first component at each of the positions, each of the first reference values being obtained referring to the third distribution; a second computing unit configured to compute, at each of the positions, a plurality of second products of second reference values for the light sources and the luminance modulation factors for the light sources, and a second sum of the second products corresponding to the light sources, and to estimate, at each of the positions, the second sum as a second component at each of the positions, each of the second reference values being obtained referring to the second distribution; and a third computing unit configured to compute, at each of the positions, a third sum of the first component and the second component, and to set the third sum as the estimated value.

DETAILED DESCRIPTION OF THE INVENTION

An information processing apparatus, and an image display apparatus and method according to embodiments of the present invention will be described in detail with reference to the accompanying drawings. In the embodiments, like reference numbers denote like elements, and duplication of explanation will be omitted.

(Illumination Intensity Distribution of Light Source)

Figure 1:
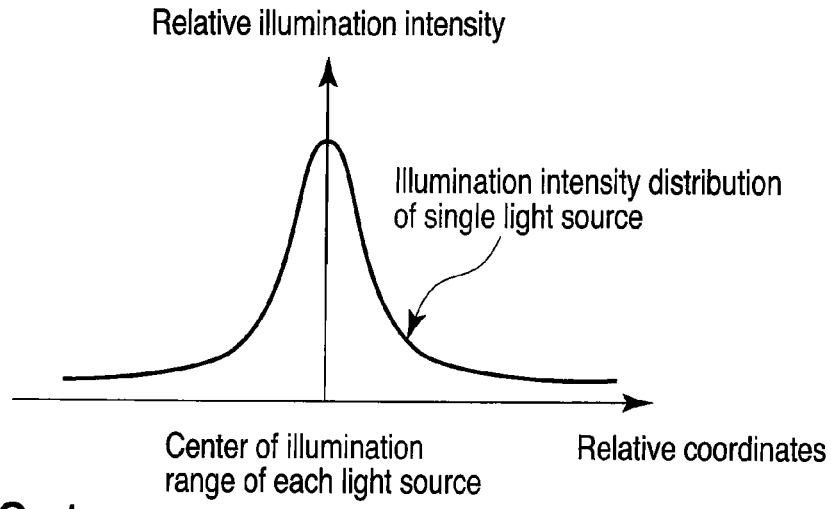
FIG. 1 is a graph illustrating an example of an illumination intensity distribution of a single light source in a first embodiment.

In the embodiments described below, the intensity of light applied to an illumination target (such as a liquid crystal panel) will be referred to simply as an "illumination intensity." Since light sources have illumination intensity distributions corresponding to their actual hardware configurations, the light beams applied by the light sources to an illumination target have their respective illumination intensity distributions corresponding to the actual hardware configurations. FIG. 1 shows the illumination intensity distribution of a single light source. As shown, the relative luminance decreases as it is away from the center of the illumination area of the light source.

The information processing apparatus, and an image display apparatus and method of the present embodiment can accurately estimate the intensity distribution of the light emitted from a light source, using a small storage capacity and a small number of computations.

First Embodiment

Figure 2:
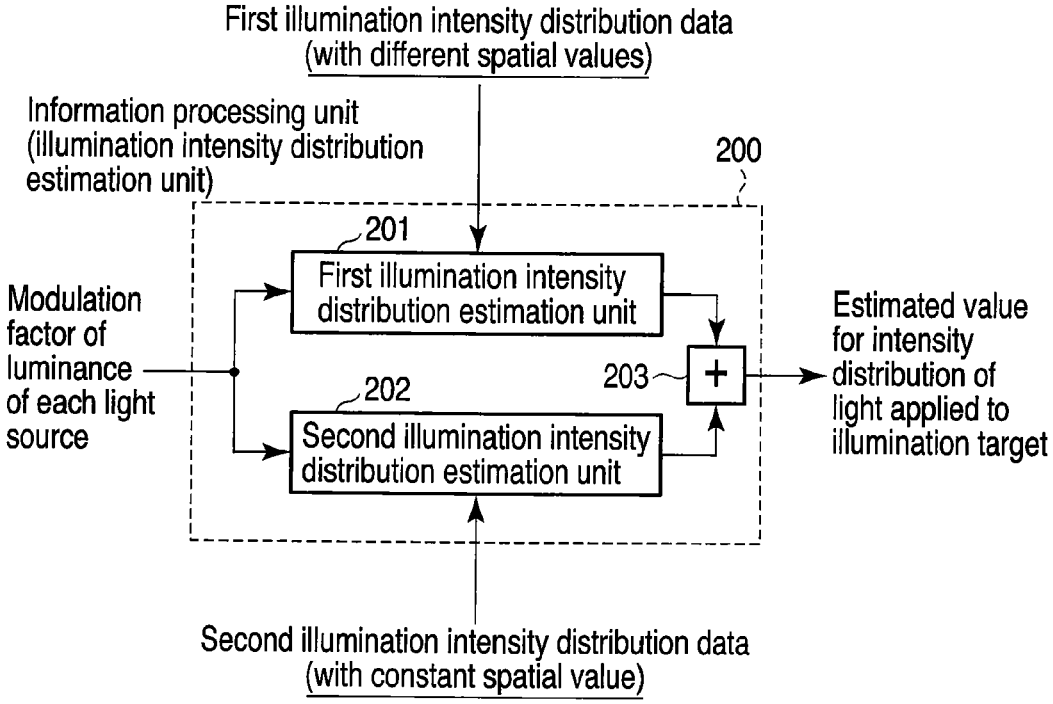
FIG. 2 is a block diagram illustrating an information processing apparatus according to the first embodiment.

Referring now to FIG. 2, a description will be given of an information processing apparatus 200 according to a first embodiment of the invention.

The information processing apparatus 200 of the first embodiment estimates, based on a luminance modulation factor input thereto, the intensity distribution of the light applied to an illumination target by at least one light source at the luminance modulation factor. The information processing apparatus 200 will be hereinafter also referred to as an illumination intensity distribution estimation unit.

The information processing apparatus 200 of the first embodiment comprises a first illumination intensity distribution estimation unit 201, a second illumination intensity distribution estimation unit 202, and an adder 203.

The first illumination intensity distribution estimation unit 201 refers to first illumination intensity distribution data having spatial variations (hereinafter referred to as "spatially different values"), to compute a component (first component) having spatially different values and related to the entire illumination intensity distribution of all light sources, based on the luminance modulation factors of the light sources. The first illumination intensity distribution data will be described later with reference to FIGS. 4 and 5.

The second illumination intensity distribution estimation unit 202 refers to second illumination intensity distribution data including a spatially constant value, to compute a component (second component) having a spatially constant value and related to the entire illumination intensity distribution of all light sources, based on the modulation factors of the light sources. The second illumination intensity distribution data will be described later with reference to FIGS. 4 and 5.

The adder 203 adds up, at each position on the illumination target, the component computed by the first illumination intensity distribution estimation unit 201 and having the spatially different values, and the component computed by the second illumination intensity distribution estimation unit 202 and having the spatially constant value, thereby acquiring the intensity distribution of the light to be applied to the illumination target, i.e., the illumination intensity distribution of all light sources.

Figure 3:
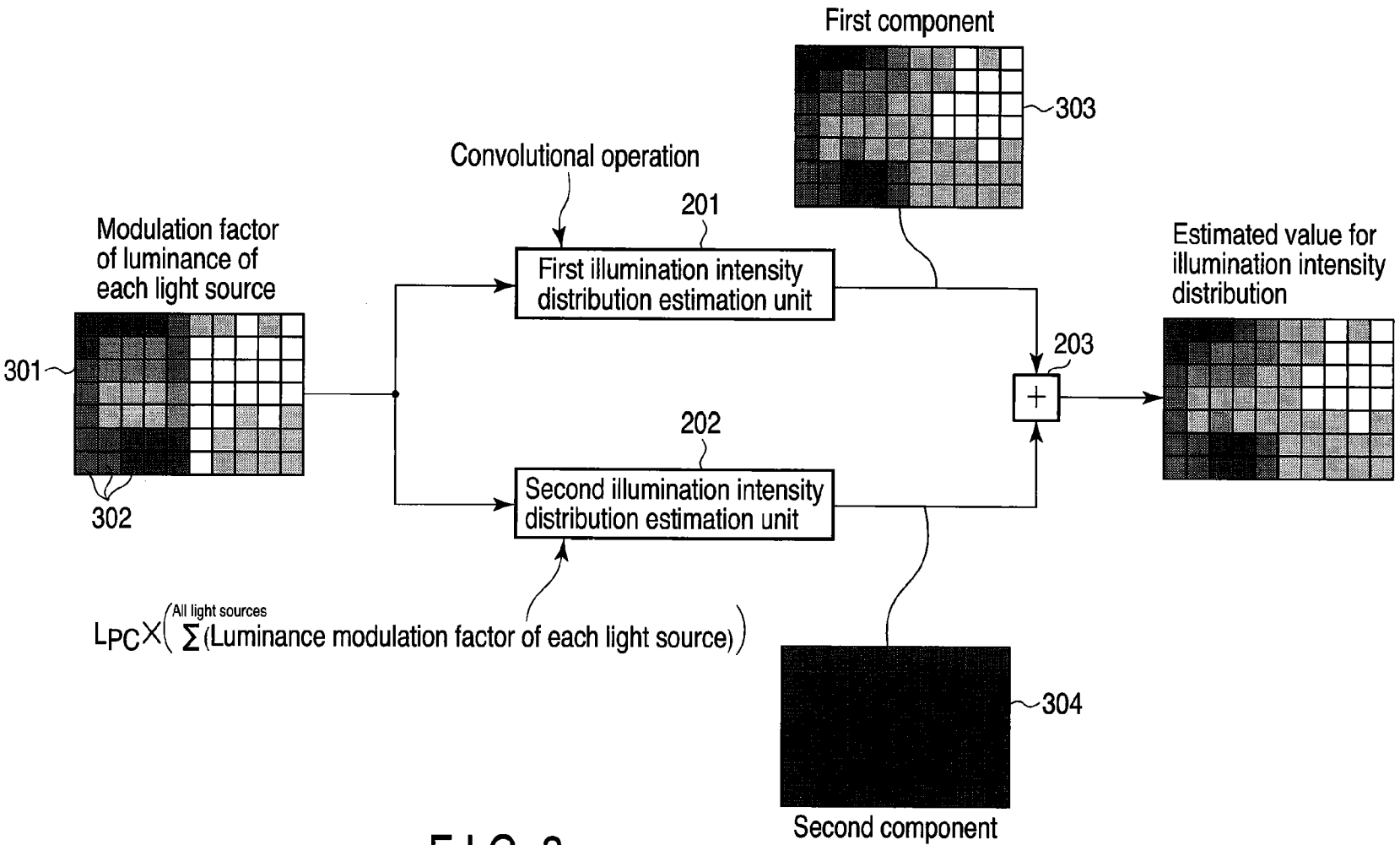
FIG. 3 is a view useful in explaining the operation of the information processing apparatus shown in FIG. 2.

FIG. 3 schematically illustrates the operation of the information processing apparatus 200. In FIG. 3, a block 301 formed of 7×10 small blocks (i.e., 7 vertical blocks×10 horizontal blocks) corresponds to the entire size of an illumination target, and the small blocks 302 correspond to respective light sources. As shown in FIG. 3, the first component computed by the first illumination intensity distribution estimation unit 201 has different values for groups of small blocks 302, while the second component computed by the second illumination intensity distribution estimation unit 202 has a constant value for all small blocks 302. Namely, the first component has spatially different values, whereas the second component has a spatially constant value.

<First and Second Illumination Intensity Distribution Data>

Figure 4:
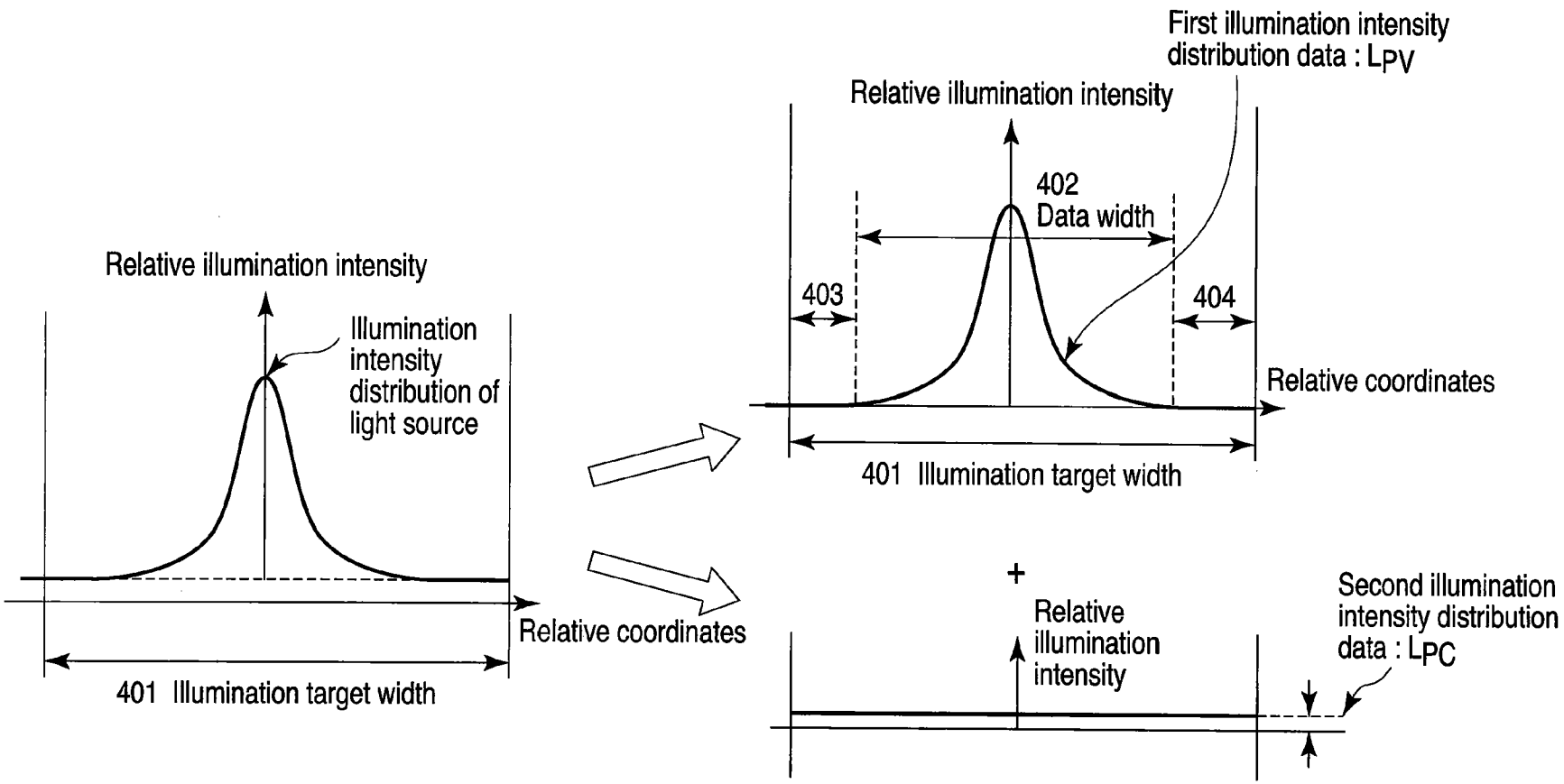
FIG. 4 shows first and second illumination intensity distribution data obtained in the first embodiment.

Referring then to FIG. 4, a description will be given of first and second illumination intensity distribution data.

As is also evident from FIG. 4, the peripheral portions of the illumination intensity distribution of a single light source can be well approximated by only the spatially constant illumination intensity distribution data, such as the second illumination intensity distribution data, since there is spatially little change in illumination intensity at the peripheral portions. Accordingly, if the illumination intensity distribution of a single light source is approximated by synthesizing illumination intensity distribution data having spatially different values and existing in a spatially narrowed range, with illumination intensity distribution data having a spatially constant value, as is shown in FIG. 4, more accurate estimation can be executed than in an approximation using, for example, only a single type of illumination intensity distribution data of a spatially narrowed range. The amount of the data width 402 of the portion, in which the first illumination intensity distribution data has values, is set not more than the width 401 of the illumination target. Namely, in FIG. 4, the data width 402 is not more than the width 401 of the illumination target by widths 403 and 404. Actually, however, low values exist even in the widths 403 and 404. In information processing executed in the embodiment, the data quantity and the number of computations can be reduced by regarding the widths 403 and 404 as 0.

Specifically, the illumination intensity distribution of a single light source is divided into illumination intensity distribution data, such as the first illumination intensity distribution data, which has spatially different values and exists in a spatially narrowed range, and illumination intensity distribution data, such as the second illumination intensity distribution data, which has a spatially constant value and exists in the entire spatial range. Approximation is executed for each of the resultant first and second illumination intensity distribution data. Based on each of the first and second illumination intensity distribution data, the intensity distribution of each light beam emitted from a plurality of light sources is estimated, and then the illumination intensity distribution of the synthesized light of the light sources is estimated. As a result, more accurate estimation can be executed than in the case where the illumination intensity distribution of a plurality of light sources is estimated referring only to a single type of illumination intensity distribution data obtained in a narrow spatial range.

Figure 5:
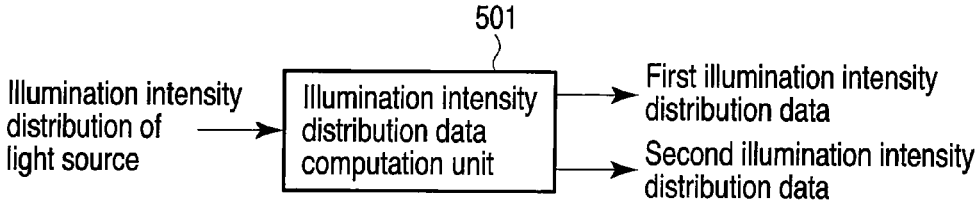
FIG. 5 is a view illustrating an illumination intensity distribution data computation unit which computes the first and second illumination intensity distribution data shown in FIG. 4.

The first and second illumination intensity distribution data shown in FIG. 4 are computed by, for example, an illumination intensity distribution data computation unit 501 as shown in FIG. 5.

The illumination intensity distribution data computation unit 501 computes the first and second illumination intensity distribution data in units of light sources. More specifically, the illumination intensity distribution data computation unit 501 divides the illumination intensity distribution of each light source into distribution data having spatially different values, and second illumination intensity distribution data having a spatially constant value, and generates first illumination intensity distribution data of a first width included in a certain illumination intensity distribution that is included in the entire illumination intensity distribution of said each light source, and has spatially different values and a second width. The center of the first width of the first illumination intensity distribution data coincides with the center of the second width of the certain distribution, and the first width is not more than the second width. Alternatively, the illumination intensity distribution data computation unit 501 may generate the first illumination intensity distribution data by regarding, as zero, any distribution portion in which the value obtained by subtracting each portion of the second illumination intensity distribution data from a corresponding portion of the illumination intensity distribution data of each light source is lower than a threshold value.

For instance, the illumination intensity distribution data computation unit 501 computes the first illumination intensity distribution data by regarding, as zero, and ignoring the illumination intensities of peripheral portions that are included in the illumination intensity distribution of each light source and each have a certain width. The illumination intensity distribution data computation unit 501 also computes the second illumination intensity distribution data including only the illumination intensity of the outer periphery of each light source. Namely, the amount of the illumination intensity distribution data as the synthesis of the first and second illumination intensity distribution data is not more than the amount of the actual illumination intensity distribution data of each light source by a quantity corresponding to the approximation executed with the peripheral portions of the first illumination intensity distribution data regarded as zero, i.e., with the spatial range of the first illumination intensity distribution data narrowed.

<Data Width of the First Illumination Intensity Distribution Data>

As described above, in the embodiment, the illumination intensity distribution of a single light source is approximated by synthesizing the first illumination intensity distribution data having spatially different values with the second illumination intensity distribution data having a spatially constant value that does not depend upon the position of data. Therefore, even if the spatial width to be held as a domain having spatially different values is narrowed, a more accurate degree of approximation than in the conventional method can be obtained. In light of this, it is desirable that the spatial width held as a domain of the first illumination intensity distribution data should be narrower than the width of an illumination target.

However, if the spatial width to be held as the range of the first illumination intensity distribution data is too narrowed, the degree of accuracy of approximation concerning the illumination intensity distribution of a single light source, and accordingly, the degree of accuracy of estimation concerning the illumination intensity distribution of a plurality of light sources, are reduced, although the required storage and/or the required number of computations can be greatly reduced. Therefore, the spatial width to be held as the range of the first illumination intensity distribution data is determined based on the memory capacity and the number of computations allowed for the application, and also based on the required accuracy of computation.

<First Illumination Intensity Distribution Estimation Unit 201>

The first illumination intensity distribution estimation unit 201 refers to such first illumination intensity distribution data as shown in FIG. 4, and executes a convolutional operation to compute a component (first component) having spatially different values associated with the entire illumination intensity distribution of a plurality of light sources. Specifically, the first illumination intensity distribution estimation unit 201 estimates, using the following equation (1), a first component $L_{BLV}$ in coordinates assumed when an $n^{th}$ light source n is lit with a luminance modulation factor $L_{set,n}$:

$$L_{BLV}(x, y) = \sum_{n=1}^{N} \{L_{set,n} \cdot L_{PV,n}(x - x_{0,n}, y - y_{0,n})\} \tag{1}$$

where x and y indicate a coordinate system spun on the illumination target, $x_{0,n}$ and $y_{0,n}$ indicate the coordinates of the center of the illumination range of the light source n, and N indicates the number of all light sources. Further, $L_{PV,n}(\xi_n, \psi_n)$ is the first illumination intensity distribution data of the light source n obtained from relative coordinates $(\xi_n, \psi_n)$ on the coordinate system, which use, as their center coordinates, the coordinates of the central point of the illumination range of the light source n. The first illumination intensity distribution estimation unit 201 firstly obtains the first illumination intensity distribution data value of a portion of each light source located at a certain position on the illumination target, referring to the first illumination intensity distribution data included in a certain illumination intensity distribution of said each light source that has spatially different values and is included in the entire illumination intensity distribution of said each light source. The first illumination intensity distribution data has a first width not more than the second width of the certain illumination intensity distribution having the spatially different values, the center of the first width being made to coincide with that of the second width. After that, the first illumination intensity distribution estimation unit 201 computes products of first reference values for light sources and luminance modulation factors for light sources, and then computes the sum of such products as this corresponding to all light sources, thereby regarding the sum as an estimated first component at the above-mentioned position. Each of the first reference values is obtained referring to a first distribution having a first width and included in a larger distribution that is included in illumination intensity distributions of the light sources, and has spatially different components and a second width. A center of the first width coincides with a center of the second width, the first width being not more than the second width.

If a spatial change in the illumination intensity distribution of each light source is considered to be substantially the same as that of any other light source, the component of the distribution having spatially different values can be approximated by a single type of illumination intensity distribution data, thereby estimating the first component using the following equation (2):

$$L_{BLV}(x, y) = \sum_{n=1}^{N} \{L_{set,n} \cdot L_{PV}(x - x_{0,n}, y - y_{0,n})\} \tag{2}$$

If this method is employed, the number of data pieces included in the first illumination intensity distribution data and held by the information processing apparatus 200 can be reduced, which means that the total quantity of the data held by the information processing apparatus 200 can be further reduced.

Figure 6:
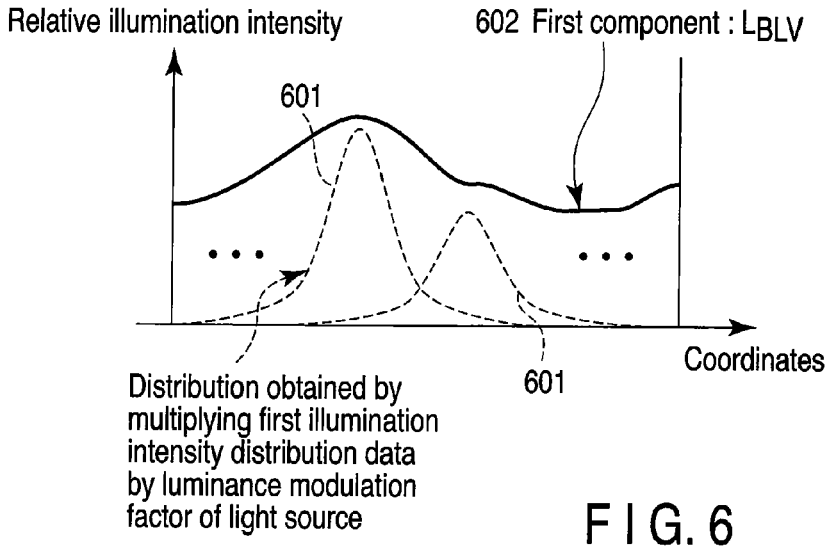
FIG. 6 is a view useful in explaining the operation of the first illumination intensity distribution estimation unit shown in FIG. 2.

FIG. 6 schematically shows the function of the first illumination intensity distribution estimation unit 201. Specifically, the first illumination intensity distribution estimation unit 201 firstly obtains the first illumination intensity distribution data value of a portion of each light source located at a certain position on the illumination target, referring to the first illumination intensity distribution data included in a certain illumination intensity distribution of said each light source that has spatially different values and is included in the entire illumination intensity distribution of said each light source. The first illumination intensity distribution data has a first width not more than the second width of the certain illumination intensity distribution having the spatially different values, the center of the first width being made to coincide with that of the second width. After that, the first illumination intensity distribution estimation unit 201 computes the product (601) of first reference values for light sources and luminance modulation factors for the light sources, and then computes the sum of such products as this corresponding to all light sources, thereby regarding the sum as an estimated first component ($L_{BLV}$) 602 at the above-mentioned position. Each of the first reference values is obtained referring to a first distribution having a first width and included in a larger distribution that is included in illumination intensity distributions of the light sources, and has spatially different components and a second width.

<Second Illumination Intensity Distribution Estimation Unit 202>

The second illumination intensity distribution estimation unit 202 refers to such second illumination intensity distribution data as shown in FIG. 4, to compute a component (second component) having a spatially constant value associated with the illumination intensity distribution of all light sources. Specifically, the second illumination intensity distribution estimation unit 202 estimates a second component $L_{BLC}$ using second illumination intensity distribution data $L_{PC,n}$ and the following equation (3):

$$L_{BLC} = \sum_{n=1}^{N} \{L_{set,n} \cdot L_{PC,n}\} \tag{3}$$

where N is the total number of the light sources. The second illumination intensity distribution estimation unit 202 firstly obtains the second illumination intensity distribution data value of each light source, referring to the second illumination intensity distribution data that is included in the illumination intensity distribution of said each light source and has a spatially constant value. After that, the second illumination intensity distribution estimation unit 202 computes the product of the obtained second illumination intensity distribution data value and the luminance modulation factor of said each light source, and then computes the sum of such products as this corresponding to all light sources, thereby regarding the sum (second sum) as an estimated second component at each position on the illumination target.

If the component obtained by subtracting a component having spatially different values from the entire illumination intensity distribution of each light source is regarded as substantially identical to the corresponding component of any other light source, it can be approximated by a single type of illumination intensity distribution data, thereby estimating the second component using the following equation (4):

$$L_{BLC} = L_{PC} \cdot \sum_{n=1}^{N} \{L_{set,n}\} \tag{4}$$

If this method is employed, the number of data pieces included in the second illumination intensity distribution data and held by the information processing apparatus 200 can be reduced, which means that the total quantity of the data held by the information processing apparatus 200 can be further reduced. The second illumination intensity distribution estimation unit 202 firstly obtains the illumination intensity of each light source, referring to the second illumination intensity distribution data that is included in the entire illumination intensity distribution of said each light source, and has a spatially constant value. After that, the second illumination intensity distribution estimation unit 202 computes the product of the obtained illumination intensity and the luminance modulation factor of said each light source, and then computes the sum of such products as this corresponding to all light sources, thereby regarding the sum as an estimated second component at each position on the illumination target.

Figure 7:
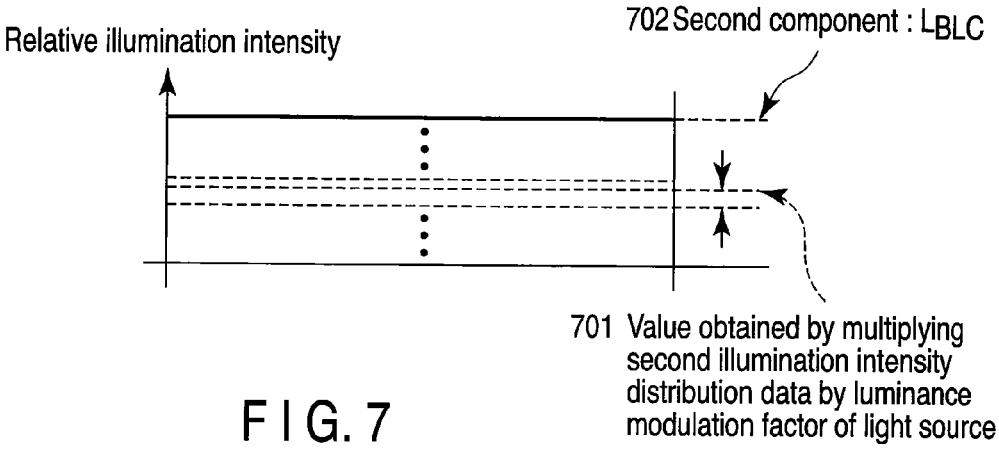
FIG. 7 is a view useful in explaining the operation of the second illumination intensity distribution estimation unit shown in FIG. 2.

FIG. 7 schematically shows the function of the second illumination intensity distribution estimation unit 202. Namely, the second illumination intensity distribution estimation unit 202 firstly obtains the second illumination intensity distribution data value of each light source, referring to the second illumination intensity distribution data that is included in the entire illumination intensity distribution of said each light source and has a spatially constant value. After that, the second illumination intensity distribution estimation unit 202 computes the product (701) of the obtained second illumination intensity distribution data value and the luminance modulation factor of each light source, and then computes the sum (second sum) of such products as the above corresponding to all light sources, thereby regarding the sum as an estimated second component ($L_{BLV}$) 702 at each position on the illumination target.

Unlike the conventional illumination intensity distribution estimation unit and the first illumination intensity distribution estimation unit 201, the second illumination intensity distribution estimation unit 202 is characterized in that it does not refer to coordinates x and y on the illumination target, or to the coordinates $x_{0,n}$ and $y_{0,n}$ of the central point of the illumination range of each light source n. Namely, the estimation unit 202 does not have to execute computation at each position on the illumination target or at each position set with respect to the center of the illumination range of each light source n. Accordingly, the number of required computations is much not more than that of the conventional illumination intensity distribution estimation unit or the first illumination intensity distribution estimation unit 201. Further, since the second illumination intensity distribution data does not depend on the position set with respect to the center of the illumination range of each light source n, it is sufficient if only a single value is held for each light source. Namely, the quantity of the second illumination intensity distribution data to be held is much not more than that of the conventional illumination intensity distribution data or the first illumination intensity distribution data.

<Adder 203>

At each position (indicated by coordinates) on the illumination target indicated by a corresponding pair of coordinates, the adder 203 adds up the component (first component) having spatially different values and computed by the first illumination intensity distribution estimation unit 201, and the component (second component) having a spatially constant value and computed by the second illumination intensity distribution estimation unit 202, thereby acquiring an estimated value for each position on the entire illumination intensity distribution of all light sources. Namely, the adder 203 computes an estimated value $L_{BL}$ for the entire illumination intensity distribution of all light sources, using the following equation (5):

$$L_{BL}(x,y)=L_{BLV}(x,y)+L_{BLC} \quad (5)$$

where x and y indicate a coordinate system spun on the illumination target. The adder 203 computes the sum of the first and second components in each position in units of position on the illumination target, and sets the sum as the estimated intensity value for the light applied to each position on the illumination target.

Figure 8:
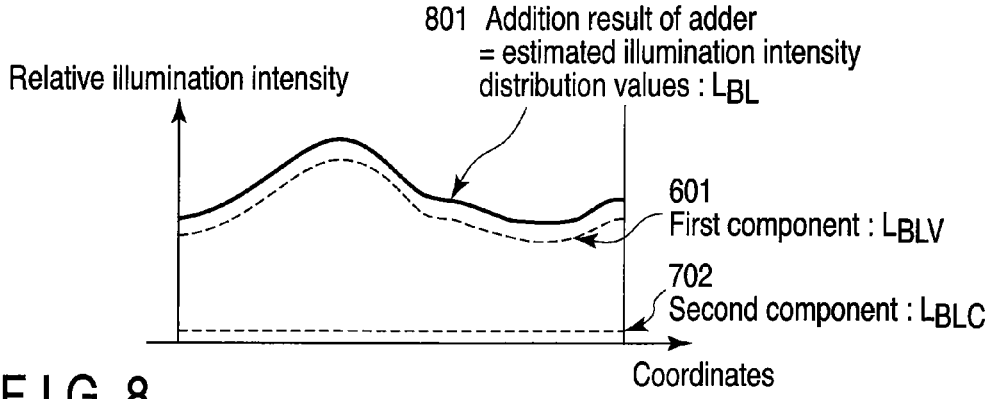
FIG. 8 is a view useful in explaining the operation of the adder shown in FIG. 2.

FIG. 8 schematically shows the function of the adder 203. As shown, at each point on the illumination target indicated by a corresponding pair of coordinates, the adder 203 adds up a first component ($L_{BLV}$) 601 computed by the first illumination intensity distribution estimation unit 201, and a second component ($L_{BLC}$) 701 computed by the second illumination intensity distribution estimation unit 202, thereby acquiring an estimated value ($L_{BL}$) 801 for the entire illumination intensity distribution of all light sources.

Advantage of the First Embodiment

As can be understood from FIG. 4, a smaller memory capacity is required for the first illumination intensity distribution data, and highly accurate approximation can be realized using the sum of the first and second illumination intensity distribution data. Further, since the second illumination intensity distribution data contains only a spatially constant value, it is sufficient if only a single value is held for each light source, and therefore the required memory capacity is much reduced.

Further, although the first illumination intensity distribution estimation unit 201 executes such a conventional convolutional operation as shown in FIG. 3, the number of computations executed in this operation is substantially equal to that of a conventional case where approximation is executed with the spatial range narrowed, and is not more than a conventional case where approximation is executed referring to the illumination intensity distribution data covering the entire width of an illumination target. Further, it is sufficient if the second illumination intensity distribution estimation unit 202 executes only product-sum operations corresponding to the number of the light sources. The number of computations required for the product-sum operations is much not more than that for the convolutional operation.

Thus, the embodiment of the invention can highly accurately estimate the intensity distribution of the light emitted from the light sources, using a small storage capacity and a small number of computations.

Second Embodiment

An information processing apparatus 200 according to a second embodiment differs from that of the first embodiment in the structure of the first illumination intensity distribution estimation unit and the method of estimating the first component.

Figure 9:
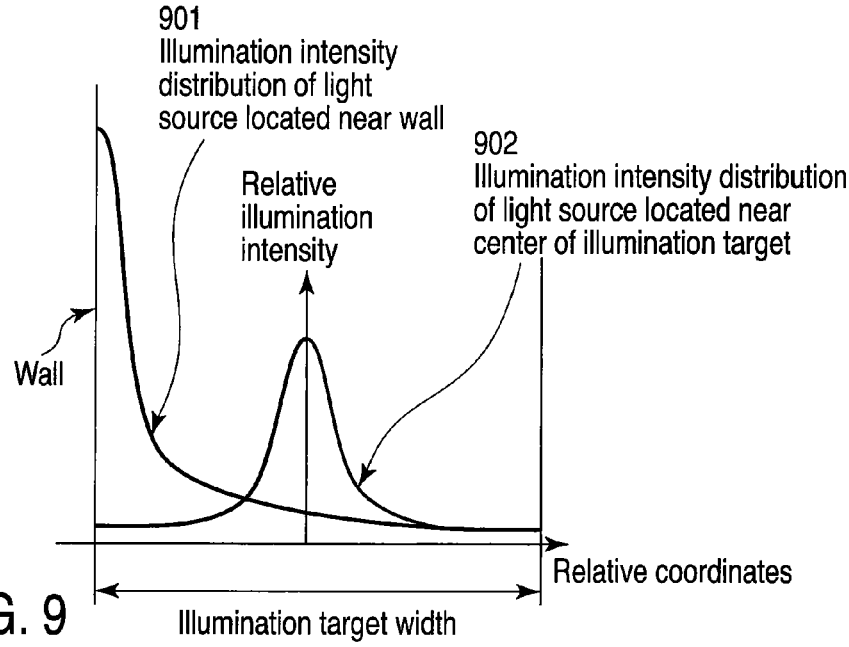
FIG. 9 is a graph illustrating an example of an illumination intensity distribution of a single light source in a second embodiment.

When a wall for reflecting light exists at, for example, an end of an illumination target, the illumination intensity distribution 901 of a light source located near the wall may significantly differ from the illumination intensity distribution 902 of a light source located near the center of the illumination target, because of the influence of reflection on the wall, as is shown in FIG. 9. In this case, different first illumination intensity distribution data values corresponding to light sources located at different positions may be prestored. Alternatively, the structure described below may be employed. FIG. 9 shows an example of an illumination intensity distribution of each single light source, assumed when a wall for reflecting light exists at an end of an illumination target.

<The First Illumination Intensity Distribution Estimation Unit of the Second Embodiment>

Figure 10:
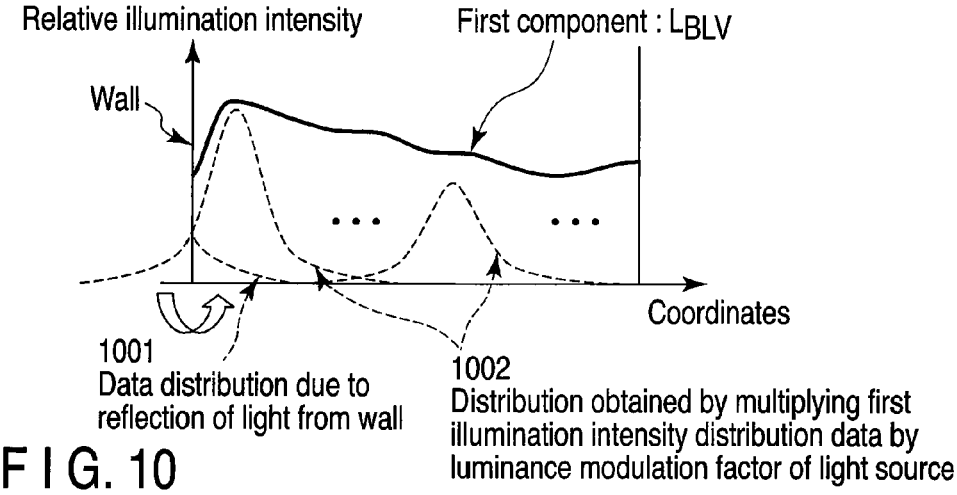
FIG. 10 is a view useful in explaining the operation of a first illumination intensity distribution estimation unit employed in the second embodiment.

As shown in FIG. 10, the first illumination intensity distribution estimation unit of the second embodiment considers the reflection 1001 of light at the wall when computing the first component. Further, the first illumination intensity distribution estimation unit of the second embodiment is similar to the first illumination intensity distribution estimation unit 201 of the first embodiment although it is not shown. Namely, the second embodiment differs from the first embodiment only in the operation of the first illumination intensity distribution estimation unit.

For each position on a second area of an illumination target larger than a first area thereof, the first illumination intensity distribution estimation unit of the second embodiment obtains the first illumination intensity distribution data value of a portion of each light source located at a certain position on the illumination target, referring to first illumination intensity distribution data of a first width included in a certain illumination intensity distribution that is included in the entire illumination intensity distribution of said each light source, and has spatially different values and a second width, the center of the first width of the first illumination intensity distribution data coinciding with that of the second width of the certain distribution, and the first width is not more than the second width. Subsequently, the first illumination intensity distribution estimation unit computes products 1002 of first reference values for light sources and luminance modulation factors for light sources, and then computes the first sum of such products as the above corresponding to all light sources. After that, the first illumination intensity distribution estimation unit estimates the first sum as a first component $L_{BLV}$ for each position included in the portion of the first area other than the another portion of the first area that overlaps a third area obtained by excluding the first area from the second area, when the third area is folded over the first area along each edge of the first area. Further, the first illumination intensity distribution estimation unit estimates the sum of the first sum associated with each position included in the first area, and the first sum associated with the corresponding position included in the third area, as the first component $L_{BLV}$ for each position included in the portion of the first area that overlaps the third area when the third area is folded over the first area along each edge of the first area.

Figure 11:
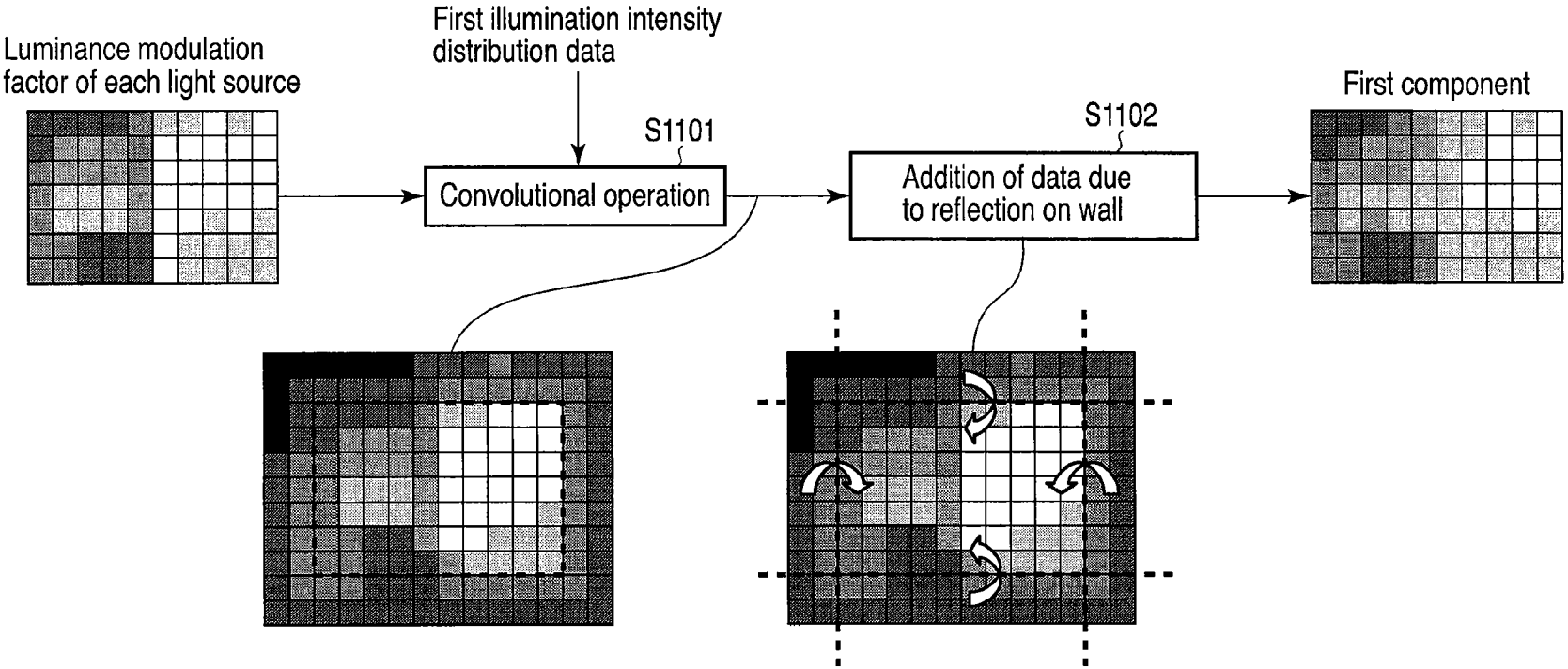
FIG. 11 is a view illustrating an example of an operation of the first illumination intensity distribution estimation unit employed in the second embodiment.
Figure 12:
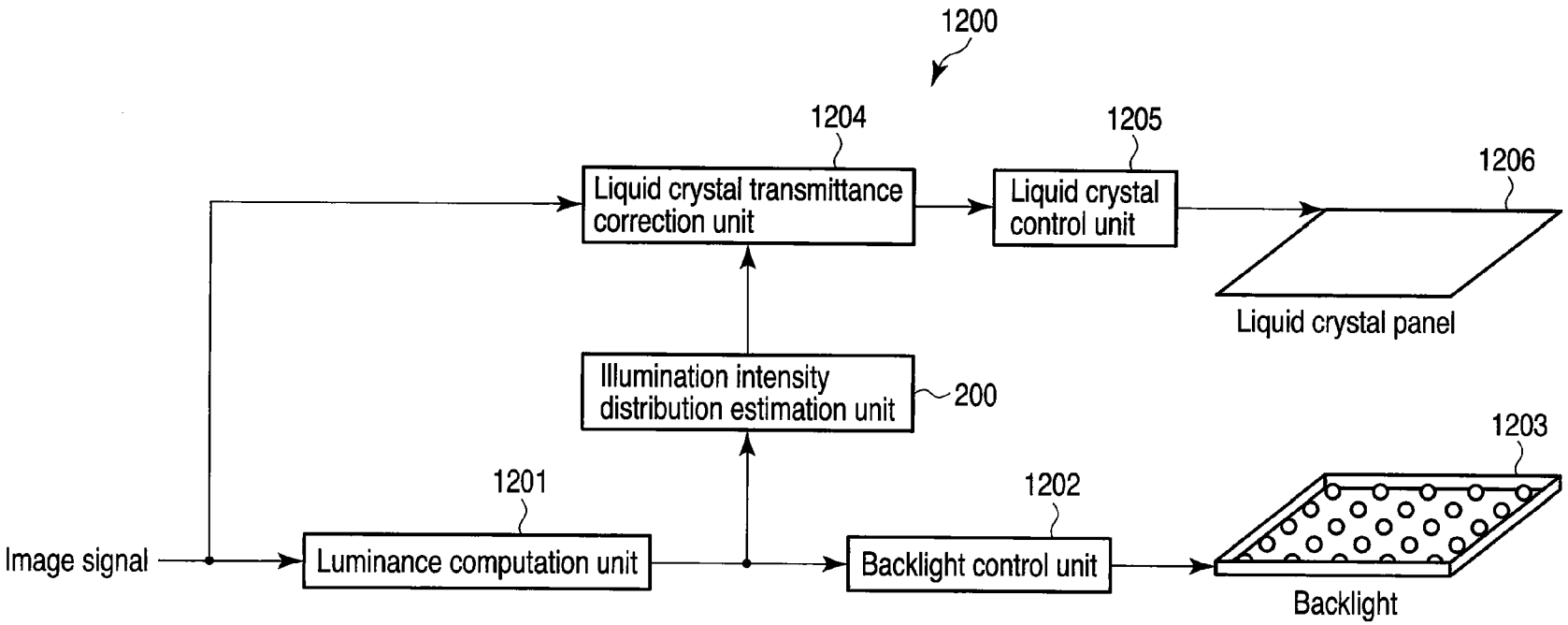
FIG. 12 is a block diagram illustrating an image display apparatus according to a third embodiment.

To be more specific, the first illumination intensity distribution estimation unit of the second embodiment computes the first component as illustrated in FIG. 11. As shown in FIG. 11, the first illumination intensity distribution estimation unit of the second embodiment firstly executes a convolutional operation to estimate a component of the illumination intensity distribution on an illumination target, which has spatially different values, using the luminance modulation factor of each light source and the first illumination intensity distribution data of each light source, in the same way as the first illumination intensity distribution estimation unit 201 (step S1101). At this point of time, however, the convolutional operation is also executed on the imaginary portion of the illumination target outside the wall, assuming that there is no wall on the illumination target.

Subsequently, the first illumination intensity distribution estimation unit of the second embodiment adds the respective illumination intensity distribution values estimated for the imaginary portions of the illumination target outside the wall, to the illumination intensity distribution values of the corresponding real portions of the illumination target that are located inside the wall and symmetrical with respect thereto (step S1102).

Thus, the first illumination intensity distribution estimation unit of the second embodiment computes the first component considering reflection of light by the wall.

In the above-described second embodiment, it is not necessary to prepare, for a light source located near the wall, first illumination intensity distribution data different from first illumination intensity distribution data for a light source located near the center of illumination target. Namely, the quantity of the first illumination intensity distribution data, and hence that of the entire illumination intensity distribution data to be held by the information processing apparatus, can be reduced.

Third Embodiment

Referring to FIGS. 12 to 17, a description will be given of an image display apparatus 1200 according to a third embodiment, which employs the information processing apparatus 200 of the first embodiment.

The image display apparatus 1200 of the third embodiment comprises an illumination intensity distribution estimation unit 200, a luminance computation unit 1201, a backlight control unit 1202, a backlight 1203, a liquid crystal transmittance correction unit 1204, a liquid crystal control unit 1205 and a liquid crystal panel 1206. The illumination intensity distribution estimation unit 200 is identical to the information processing unit 200 of the first embodiment.

The luminance computation unit 1201 computes the luminance modulation factor of each light source suitable for display, based on an image signal received.

The backlight control unit 1202 controls the intensities of the light sources providing the backlight 1203, based on the luminance modulation factor of each light source computed by the luminance computation unit 1201. The backlight control unit 1202 can individually control the emission intensities (luminance levels) and emission timings of the light sources included in the backlight 1203.

The backlight 1203 has a plurality of light sources that have their intensities controlled by the backlight control unit 1202, and emit light to the liquid crystal panel 1206 from behind.

The illumination intensity distribution estimation unit 200 receives the luminance modulation factor of each light source computed by the luminance computation unit 1201, and computes an estimated value for each position on the illumination intensity distribution of the light emitted from the backlight 1203 to the liquid crystal panel 1206 when the backlight 1203 is turned on with each computed modulation factor.

The liquid crystal transmittance correction unit 1204 acquires the estimated value for each position on the illumination intensity distribution of the backlight 1203 computed by the illumination intensity distribution estimation unit 200, and also acquires image signals corresponding to each pixel, thereby correcting the image signal transmittances of each pixel of the liquid crystal panel 1206 based on the acquired estimated value and image signals, and outputting the corrected transmittances to the liquid crystal control unit 1205.

The liquid crystal control unit 1205 controls the liquid crystal panel 1206 to set the liquid crystal transmittance corrected by liquid crystal transmittance correction unit 1204.

The liquid crystal panel 1206 is of, for example, an active matrix type, in which a plurality of signal lines and a plurality of scanning lines intersecting the signal lines are arranged on an array substrate with an insulating film interposed therebetween, pixels being arranged at the intersections of both types of lines. This structure will be described later in detail with reference to FIG. 17.

<Backlight 1203>

Figure 13:
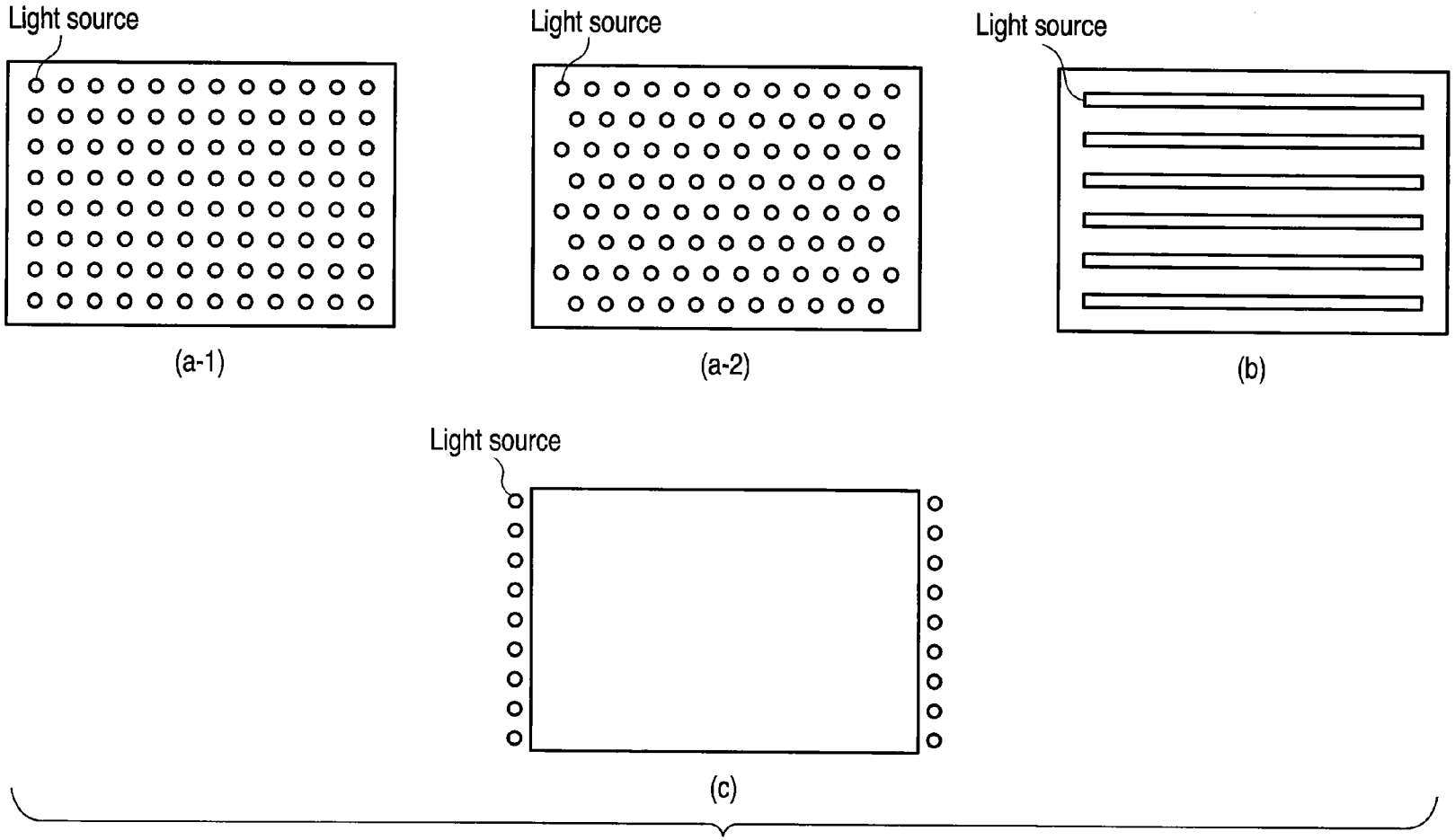
FIG. 13 is a view illustrating examples of the backlight shown in FIG. 12.

FIGS. 13(*a*-1), 13(*a*-2), 13(*b*) and 13(*c*) show examples of the backlight 1203.

As shown in these figures, the backlight 1203 comprises at least one light source. The light sources may be arranged on the back of the liquid crystal panel 1206 as shown in FIGS. 13(*a*-1), 13(*a*-2) and 13(*b*). Alternatively, they may be arranged at both edges of the liquid crystal panel 1206 such that and light will be guided to the back of the liquid crystal panel 1206 using a light guiding plate or reflector.

Figure 14A:
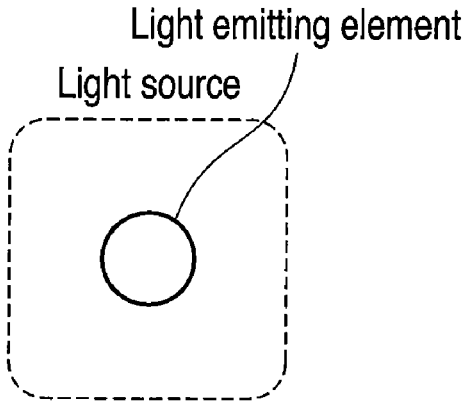
FIGS. 14A and 14B are views illustrating examples of the light source (backlight) shown in FIG. 12.
Figure 14B:
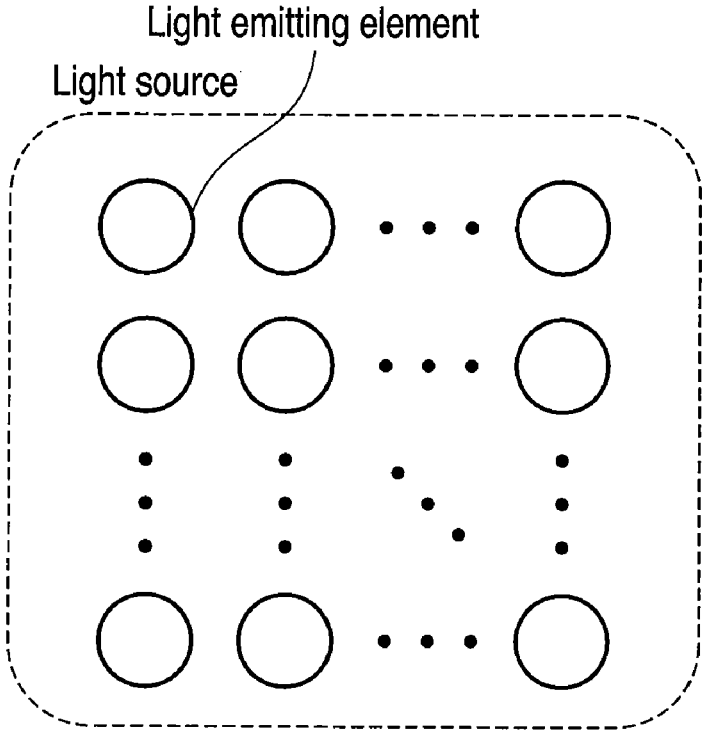

Each of the light sources shown in FIGS. 13(*a*-1), 13(*a*-2), 13(*b*) and 13(*c*) may be formed of a single light emitting element as shown in FIG. 14 (*a*), or may be formed of a plurality of light emitting elements arranged parallel to or vertical to the liquid crystal panel 1206 as shown in FIG. 14 (*b*).

An LED, a cold cathode and a hot cathode are suitable as the light emitting elements. In particular, since LEDs have a wide range of luminance ranging from a maximum to minimum luminance levels, and can be controlled with high dynamic range, they are preferable as light emitting elements. The emission intensity (luminance) and emission timing of each light source can be controlled by the backlight control unit 1202.

<Luminance Computation Unit 1201>

Figure 15:
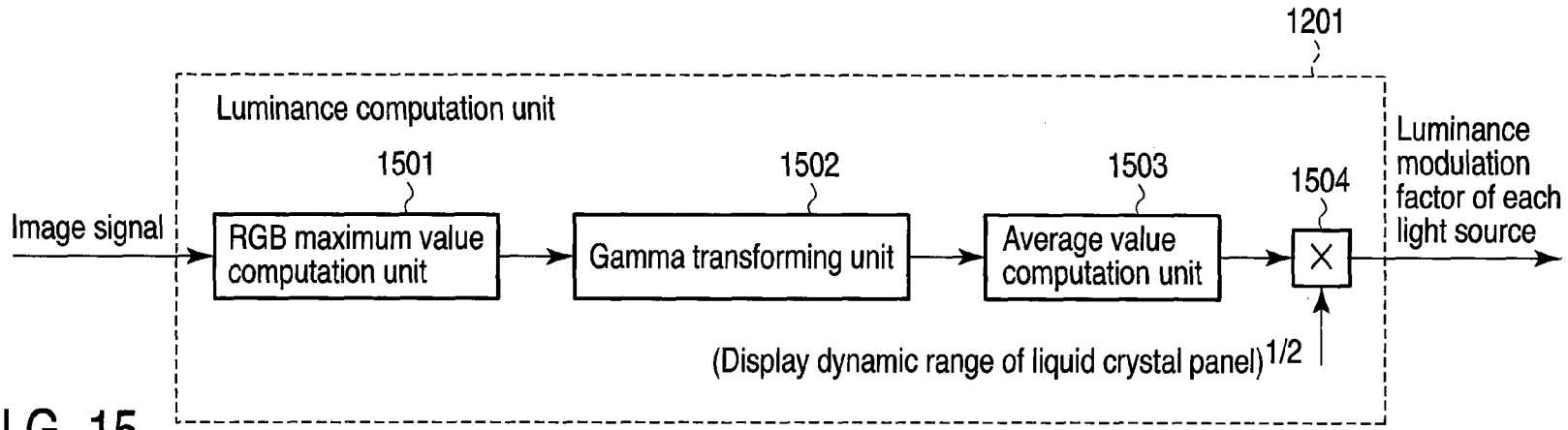
FIG. 15 is a block diagram illustrating an example of the luminance computation unit shown in FIG. 12.

Referring to FIG. 15, the luminance computation unit 1201 will be described. The luminance computation unit 1201 includes an RGB maximum value computation unit 1501, a gamma transforming unit 1502, an average value computation unit 1503 and a multiplying unit 1504.

The RGB maximum value computation unit 1501 acquires and outputs the maximum value of the R, G and B image signals of each pixel. Hereinafter, the signal computed by the RGB maximum value computation unit 1501 will be refereed to as a "RGB maximum signal."

The gamma transforming unit 1502 transforms an input RGB maximum signal into a relative luminance $L_{MAX}$ by gamma transformation. Assuming that the input image signal falls within a range of [0, 255], the transformation is given by, for example, the following equation:

$$L_{MAX}=(1-\alpha)(S_{MAX}/255)^{\gamma}+\alpha \tag{6}$$

where $S_{MAX}$ is the RGB maximum signal computed by the RGB maximum value computation unit 1501. Although $\gamma$ and $\alpha$ may be any real numbers, $\alpha$ and $\gamma$ are set to 0.0 and 2.2, respectively, to execute the transformation most briefly. The transformation may be directly executed using, for example, the multiplying unit, or may be executed using a lookup table. The relative luminance $L_{MAX}$ computed using the RGB maximum value computation unit 1501 and the gamma transforming unit 1502 will hereafter be referred to as an "RGB maximum luminance value."

The average value computation unit 1503 computes an average RGB maximum luminance value from the RGB maximum luminance values of a plurality of pixels in a spatial range corresponding to the illumination range of each light source included in the backlight 1203. The target spatial range of the average value computation unit 1503, in which the above-mentioned average value is computed, may be substantially equal to the illumination range of each light source, or may be smaller or larger than the same.

The multiplying unit 1504 multiplies a relative luminance value, computed by the average value computation unit 1503 as the average of the luminance values of the light sources, by the square root of the display dynamic range of the liquid crystal panel 1206.

The luminance computation unit 1201 outputs the value, computed by the multiplying unit 1504, as the luminance modulation factor of each light source.

<Liquid Crystal Transmittance Correction Unit 1204>

Figure 16:
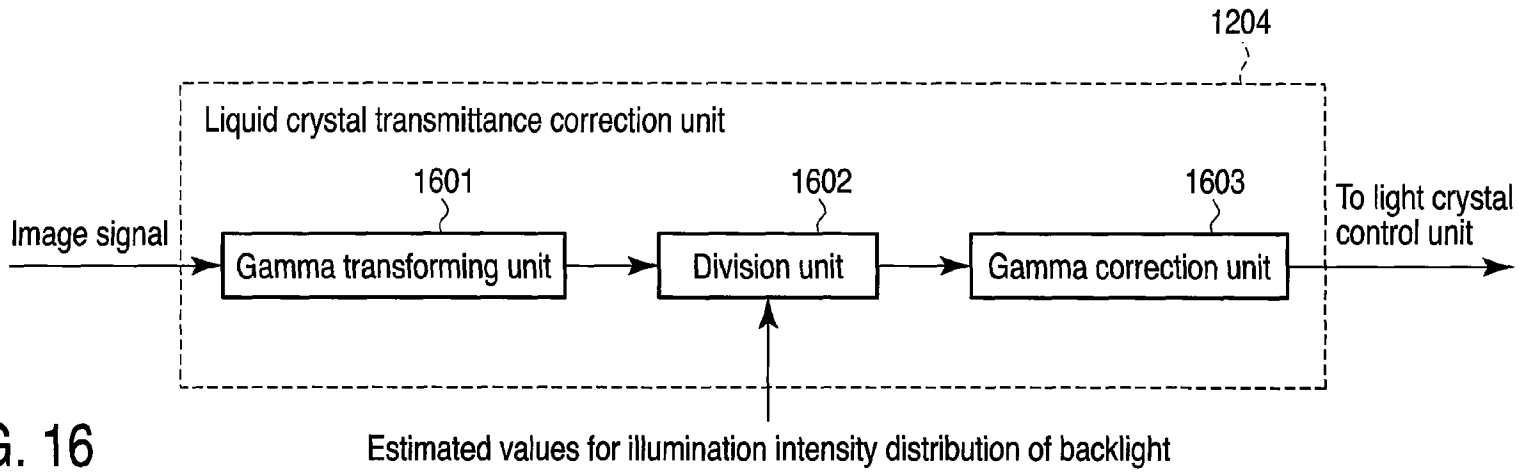
FIG. 16 is a block diagram illustrating an example of the liquid crystal transmissivity correction unit shown in FIG. 12.

Referring then to FIG. 16, a description will be given of a specific example of the liquid crystal transmittance correction unit 1204.

The liquid crystal transmittance correction unit 1204 comprises a gamma transformation unit 1601, a division unit 1602 and a gamma correction unit 1603.

The gamma transformation unit 1601 transforms input image signals into R, G and B light transmittances. Namely, the gamma transformation unit 1601 executes the transformations given by the following equations (7):

$$\begin{cases} T_R = (1-\alpha)(S_R/255)^{\gamma}+\alpha, \\ T_G = (1-\alpha)(S_G/255)^{\gamma}+\alpha, \\ T_B = (1-\alpha)(S_B/255)^{\gamma}+\alpha, \end{cases} \tag{7}$$

where $S_R$, $S_G$ and $S_B$ are image signal values corresponding to R, G and B, respectively, and $T_R$, $T_G$ and $T_B$ are light transmittances corresponding to R, G and B, respectively. The values of $\gamma$ and $\alpha$ used in the gamma transformation unit may be equal to or different from those of the gamma transformation unit 1502 of the luminance computation unit 1201.

The division unit 1602 computes corrected light transmittances, based on the R, G and B light transmittances of each pixel, and the estimated value computed by the information processing apparatus 200 for each position on the illumination intensity distribution of the backlight 1203.

The gamma correction unit 1603 executes gamma correction on the corrected light transmittances computed by the division unit 1602, and converts the resultant signals into image signals to be output to the liquid crystal control unit. Assuming that the output image signals are signals falling within a range of [0, 255] corresponding to R, G and B, the gamma correction is executed using the following equations (8):

$$\begin{cases} S'_R = 255\times\{(T'_R-\alpha)/(1-\alpha)\}^{1/\gamma}, \\ S'_G = 255\times\{(T'_G-\alpha)/(1-\alpha)\}^{1/\gamma}, \\ S'_B = 255\times\{(T'_B-\alpha)/(1-\alpha)\}^{1/\gamma}, \end{cases} \tag{8}$$

where $T'_R$, $T'_G$ and $T'_B$ are the corrected light transmittances corresponding to R, G and B, respectively, and $S'_R$, $S'_G$ and $S'_B$ are the output image signals corresponding to R, G and B, respectively. $\gamma$ and $\alpha$ may be arbitrary real numbers. However, if $\gamma$ and $\alpha$ are set to the gamma value and minimum light transmittance of the liquid crystal panel 1206, respectively, an image faithful to the input signals can be reproduced. The gamma correction is not limited to this, but may be changed to a known transformation method when necessary, or to an inverse transformation method using a gamma transformation table for the liquid crystal panel. These transformations may be directly executed using, for example, a multiplier, or executed using a lookup table.

The division unit 1602 may compute the corrected light transmittances by dividing the R, G and B light transmittances of each pixel computed by the gamma transformation unit 1601, by the estimated value computed by the information processing apparatus 200 for each position on the illumination intensity distribution of the backlight 1203. Alternatively, the division unit 1602 may compute the corrected light transmittances, referring to a lookup table that is beforehand prepared and holds correspondence values associated with the inputs and outputs.

<Liquid Crystal Panel 1206>

Figure 17:
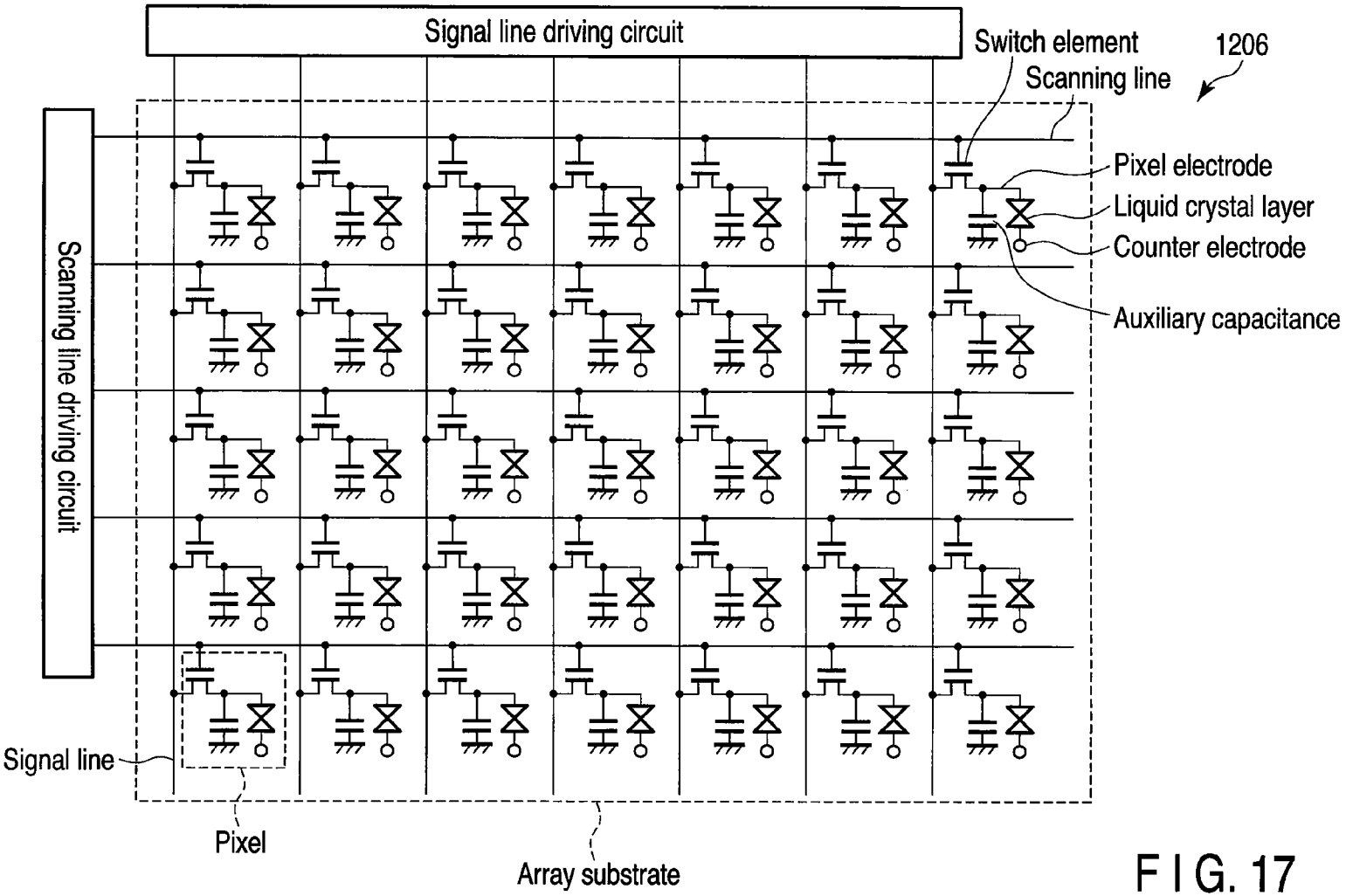
FIG. 17 is a view illustrating the structure of the liquid crystal panel shown in FIG. 12.

The liquid crystal panel 1206 is of, for example, an active matrix type, and comprises an array substrate, a plurality of signal lines, a plurality of scanning lines intersecting the signal lines, and a plurality of pixels arranged at the intersections of the lines, the signal lines and scanning lines being arranged on the array substrate with an insulating film interposed therebetween, as is shown in FIG. 17. The signal lines are connected to a signal line driving circuit, and the scanning lines are connected to a scanning line driving circuit. Each pixel includes a switch element formed of a thin film transistor (TFT), a pixel electrode, a liquid crystal layer, an auxiliary capacitance, and a counter electrode. The counter electrode is connected in common to all pixels. The switch element is provided for writing a video signal. The gates of switch elements arranged in each row are connected in common to the corresponding scanning line, and the sources of the switch elements arranged in each column are connected in common to the corresponding signal line. Further, the drains of the switch elements are connected to the respective pixel electrodes, and also to the respective auxiliary capacitances connected electrically in parallel to the pixel electrodes.

The pixel electrodes are provided on the array substrate, and the counter electrodes electrically opposite to the pixel electrodes are provided on a counter substrate (not shown). A counter-voltage generation circuit (not shown) applies a preset counter voltage to the counter electrodes. A liquid crystal layer is interposed between the pixel electrodes and the counter electrodes, and the peripheries of the array substrate and the counter substrate are sealed with a seal member (not shown). The material of the liquid crystal layer is, preferably, ferromagnetic liquid crystal, or liquid crystal of an optically compensated bend (OCB) mode.

The scanning-line driving circuit is formed of, a shift register, a level shifter, a buffer circuit, and the like (which are not shown). The scanning-line driving circuit outputs a row selection signal to each scanning line based on a vertical start signal or a vertical clock signal output as control signals from a display ratio control unit (not shown).

The signal-line driving circuit includes, for example, an analog switch, a shift register, a sample hold circuit and a video bus (which are not shown). The signal-line driving circuit receives a horizontal start signal and a horizontal clock signal output as control signals from the display ratio control unit, and receives input signals.

The image display apparatus according to the third embodiment can accurately estimate the intensity distribution of the light emitted from a light source, using a small storage capacity and a small number of computations. Therefore, the apparatus of the third embodiment can execute high quality display of a wide dynamic range using small storage capacity and a small number of computations.

In the above-described embodiments, the intensity distribution of the light emitted from each light source is approximated by illumination intensity distribution data having spatially different values and illumination intensity distribution data having a spatially constant value. Further, a component of the intensity distribution of the light emitted from a plurality of light sources, which has spatially different values, and a component of the same which has a spatially constant value are estimated, and the estimated components are synthesized to obtain an estimated value for each position on the intensity distribution of the light emitted from a plurality of light sources.

Since the intensity distribution of the light emitted from a single light source has spatially little changes at its peripheral portions, and hence the illumination intensity distribution of the peripheral portions can be well approximated only by illumination intensity distribution data having a spatially constant value. Accordingly, even if the spatial range of the illumination intensity distribution data having spatially different values is narrowed, approximation executed by synthesizing the two types of data exhibits higher accuracy than approximation executed using a single type of data with a narrowed spatial range. This being so, more accurate estimation than the estimation of the intensity distribution of the light emitted from a plurality of light sources, executed referring only to a single type of data with a spatially narrowed spatial range, can be realized by approximating the intensity distribution of the light, emitted from each light source, by illumination intensity distribution data having spatially different values and illumination intensity distribution data having a spatially constant value, then estimating the intensity distribution of the light emitted from a plurality of light sources, based on these two types of data, and synthesizing the estimation results to estimate the intensity distribution of the light emitted from the light sources.

Furthermore, since the illumination intensity distribution data having a spatially constant value can be formed of only a single value set for each light source, only a small storage capacity is required. In addition, where the illumination intensity distribution of light is estimated referring to illumination intensity distribution data having a spatially constant value, it is not necessary to execute computation in each position on an illumination target, thereby reducing the number of required computations.

As described above, the embodiments of the present invention can accurately estimate the intensity distribution of the light, emitted from a plurality of light sources, using a small storage capacity or a small number of computations.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display apparatus comprising:

a liquid crystal panel including a plurality of pixels arranged in a matrix-like manner;

a backlight including at least one light source which applies light to the liquid crystal panel, the backlight adjusting the light emitted from the at least one light source;

a computation unit configured to compute a luminance modulation factor of the at least one light source based on an image signal corresponding to each of the pixels;

a first control unit configured to control the backlight based on the computed luminance modulation factor;

an estimation unit configured to estimate an estimated value for each position on an intensity distribution of light applied by the backlight to the liquid crystal panel, based on the computed luminance modulation factor;

a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes: a first computing unit configured to compute, at each of positions on the illumination target, a plurality of first products of first reference values for light sources and luminance modulation factors for the light sources, and a first sum of the first products corresponding to the light sources, and to estimate, at each of the positions, the first sum as a first component at each of the positions, each of the first reference values being obtained referring to a first distribution having a first width and included in a larger distribution that is included in illumination intensity distributions of the light sources, and has spatially different components and a second width, a center of the first width coinciding with a center of the second width, the first width being not more than the second width;

a second computing unit configured to compute a second sum of the luminance modulation factors for all of the light sources, and a second product of the second sum and second reference value, and to estimate, at each of the positions, the second product as a second component at each of the positions, the second reference value being obtained referring to a second distribution that is included in the illumination intensity distributions of the light sources, and has a spatially constant value; and a third computing unit configured to compute, at each of the positions, a third sum of the first component and the second component, and to set the third sum as the estimated value.

2. The apparatus according to claim 1, wherein the first computing unit estimates the first sum as a first component for each position on a first portion of a first area on an illumination target, and to estimate, as the first component for each position on a second portion of the first area, a sum of the first sum associated with each position on the second portion and the first sum associated with each position that is included in a third area and corresponds to said each position on the second portion, the third area being obtained by eliminating the first area from a second area larger than the first area, the second portion overlapping the third area when the third area is folded over the first area along an edge of the first area, the first portion being other than the second portion.

3. A display apparatus comprising:

a liquid crystal panel including a plurality of pixels arranged in a matrix-like manner;

a backlight including at least one light source which applies light to the liquid crystal panel, the backlight adjusting the light emitted from the at least one light source;

a computation unit configured to compute a luminance modulation factor of the at least one light source based on an image signal corresponding to each of the pixels;

a first control unit configured to control the backlight based on the computed luminance modulation factor;

an estimation unit configured to estimate an estimated value for each position on an intensity distribution of light applied by the backlight to the liquid crystal panel, based on the computed luminance modulation factor;

a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes:

a first computing unit configured to compute, at each of positions on the illumination target, a plurality of first products of first reference values for light sources and luminance modulation factors for the light sources, and a first sum of the first products corresponding to the light sources, and to estimate, at each of the positions, the first sum as a first component at each of the positions, each of the first reference values being obtained referring to a first distribution having a first width and included in a larger distribution that is included in illumination intensity distributions of the light sources, and has spatially different component and a second width, a center of the first width coinciding with a center of the second width, the first width being not more than the second width;

a second computing unit configured to compute, at each of the positions, a plurality of second products of second reference values for the light sources and the luminance modulation factors for the light sources, and a second sum of the second products corresponding to the light sources, and to estimate, at each of the positions, the second sum as a second component at each of the positions, each of the second reference values being obtained referring to a second distribution that is included in the illumination intensity distributions of the light sources, and has a spatially constant value; and a third computing unit configured to compute, at each of the positions, a third sum of the first component and the second component, and to set the third sum as an estimated value at each of the positions for an intensity distribution of light applied by the light sources to each of the positions.

4. The apparatus according to claim 3, wherein the first computing unit estimates the first sum as a first component for each position on a first portion of a first area on an illumination target, and to estimate, as the first component for each position on a second portion of the first area, a sum of the first sum associated with each position on the second portion and the first sum associated with each position that is included in a third area and corresponds to said each position on the second portion, the third area being obtained by eliminating the first area from a second area larger than the first area, the second portion overlapping the third area when the third area is folded over the first area along an edge of the first area, the first portion being other than the second portion.

5. A display apparatus comprising:

a liquid crystal panel including a plurality of pixels arranged in a matrix-like manner;

a backlight including at least one light source which applies light to the liquid crystal panel, the backlight adjusting the light emitted from the at least one light source;

a computation unit configured to compute a luminance modulation factor of the at least one light source based on an image signal corresponding to each of the pixels;

a first control unit configured to control the backlight based on the computed luminance modulation factor;

an estimation unit configured to estimate an estimated value for each position on an intensity distribution of light applied by the backlight to the liquid crystal panel, based on the computed luminance modulation factor;

a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes:

a separation unit configured to separate an illumination intensity distribution of each of light sources into a first distribution having spatially different component and a second distribution having a spatially constant value;

a generation unit configured to generate a third distribution of the illumination intensity distribution having a first width not more than a second width of the first distribution, the first width having a center coinciding with a center of the second width;

a first computing unit configured to compute, at each of positions on the illumination target, a plurality of first products of values of first reference values for light sources and luminance modulation factors for the light sources, and a first sum of the first products corresponding to the light sources, and to estimate, at each of the positions, the first sum as a first component at each of the positions, each of the first reference values being obtained referring to the third distribution;

a second computing unit configured to compute a second sum of the luminance modulation factors for all of the light sources, and a second product of the second sum and second reference value, and to estimate, at each of the positions, the second product as a second component at each of the positions, the second reference value being obtained referring to the second distribution; and a third computing unit configured to compute, at each of the positions, a third sum of the first component and the second component, and to set the third sum as the estimated value.

6. The apparatus according to claim 5, wherein the generation unit generates the third distribution, regarding, as zero, a distribution that is obtained by subtracting the second distribution from the illumination intensity distribution, and has values not more than a threshold value.

7. A display apparatus comprising:

a liquid crystal panel including a plurality of pixels arranged in a matrix-like manner;

a backlight including at least one light source which applies light to the liquid crystal panel, the backlight adjusting the light emitted from the at least one light source;

a computation unit configured to compute a luminance modulation factor of the at least one light source based on an image signal corresponding to each of the pixels;

a first control unit configured to control the backlight based on the computed luminance modulation factor;

an estimation unit configured to estimate an estimated value for each position on an intensity distribution of light applied by the backlight to the liquid crystal panel, based on the computed luminance modulation factor;

a correction unit configured to correct an image signal transmittance of each pixel based on the image signal and the estimated value; and a second control unit configured to control the liquid crystal panel to set the image signal transmittance equal to the corrected light transmittance, wherein using the liquid crystal panel as the illumination target, the estimation unit includes:

a separation unit configured to separate an illumination intensity distribution of each of light sources into a first distribution having spatially different component and a second distribution having a spatially constant value;

a generation unit configured to generate a third distribution of the illumination intensity distribution having a first width not more than a second width of the first distribution, the first width having a center coinciding with a center of the second width;

a first computing unit configured to compute, at each of positions on the illumination target, a plurality of first products of values of first reference values for light sources and luminance modulation factors for the light sources, and a first sum of the first products corresponding to the light sources, and to estimate, at each of the positions, the first sum as a first component at each of the positions, each of the first reference values being obtained referring to the third distribution;

a second computing unit configured to compute, at each of the positions, a plurality of second products of second reference values for the light sources and the luminance modulation factors for the light sources, and a second sum of the second products corresponding to the light sources, and to estimate, at each of the positions, the second sum as a second component at each of the positions, each of the second reference values being obtained referring to the second distribution; and a third computing unit configured to compute, at each of the positions, a third sum of the first component and the second component, and to set the third sum as the estimated value.

8. The apparatus according to claim 7, wherein the generation unit generates the third distribution, regarding, as zero, a distribution that is obtained by subtracting the second distribution from the illumination intensity distribution, and has values not more than a threshold value.

9. A display method comprising:

preparing a liquid crystal panel including a plurality of pixels arranged in a matrix-like manner;

preparing a backlight including at least one light source which applies light to the liquid crystal panel, the backlight adjusting the light emitted from the at least one light source;

computing a luminance modulation factor of the at least one light source based on an image signal corresponding to each of the pixels;

controlling the backlight based on the computed luminance modulation factor;

estimating an estimated value for each position on an intensity distribution of light applied by the backlight to the liquid crystal panel, based on the computed luminance modulation factor;

correcting an image signal transmittance of each pixel based on the image signal and the estimated value; and controlling the liquid crystal panel to set the image signal transmittance equal to the corrected light transmittance, wherein using the liquid crystal panel as the illumination target, estimating the estimated value includes:

computing, at each of positions on the illumination target, a plurality of first products of first reference values for light sources and luminance modulation factors for the light sources, and a first sum of the first products corresponding to the light sources, and estimating, at each of the positions, the first sum as a first component at each of the positions, each of the first reference values being obtained referring to a first distribution having a first width and included in a larger distribution that is included in illumination intensity distributions of the light sources, and has spatially different components and a second width, a center of the first width coinciding with a center of the second width, the first width being not more than the second width;

computing a second sum of the luminance modulation factors for all of the light sources, and a second product of the second sum and second reference value, and estimating, at each of the positions, the second product as a second component at each of the positions, the second reference value being obtained referring to a second distribution that is included in the illumination intensity distributions of the light sources, and has a spatially constant value; and computing, at each of the positions, a third sum of the first component and the second component, and setting the third sum as the estimated value.

* * * * *